United States Patent [19]

Sugimoto et al.

[11] Patent Number: 4,585,729

[45] Date of Patent: Apr. 29, 1986

[54] SILVER HALIDE PHOTOGRAPHIC LIGHT-SENSITIVE MATERIAL

[75] Inventors: Tadao Sugimoto; Sumito Yamada, both of Kanagawa, Japan

[73] Assignee: Fuji Photo Film Co., Ltd., Kanagawa, Japan

[21] Appl. No.: 696,861

[22] Filed: Jan. 30, 1985

Related U.S. Application Data

[63] Continuation of Ser. No. 447,827, Dec. 8, 1982, abandoned.

[30] Foreign Application Priority Data

Jan. 27, 1982 [JP] Japan ..... 57-11175

[51] Int. Cl.[4] ..... G03C 1/02; G03C 5/16

[52] U.S. Cl. ..... 430/502; 430/495; 430/509; 430/539; 430/567; 430/966

[58] Field of Search ..... 430/495, 502, 509, 539, 430/567, 966

[56] References Cited

U.S. PATENT DOCUMENTS

| | | | |
|---|---|---|---|
| 3,923,515 | 12/1975 | van Stappen | 430/966 |
| 4,399,215 | 8/1983 | Wey | 430/567 |
| 4,400,463 | 8/1983 | Maskasky | 430/567 |
| 4,411,986 | 10/1983 | Abbott et al. | 430/567 |

OTHER PUBLICATIONS

Research Disclosure, Aug. 1979, vol. 184, pp. 433–441, #18431.

*Primary Examiner*—Mary F. Downey

*Attorney, Agent, or Firm*—Sughrue, Mion, Zinn, Macpeak and Seas

[57] ABSTRACT

A silver halide photographic light-sensitve material is disclosed. The material is comprised of a transparent support having provided on one side of the support at least two silver halide emulsion layers and a surface-protecting layer. One of the two silver halide emulsion layers is a tabular silver halide emulsion layer containing tabular silver halide grains having a diameter at least five times the thickness of the grains. The other silver halide emulsion layer is a non-tabular silver halide emulsion layer containing non-tabular silver halide grains. The tabular silver halide emulsion layer is positioned closer to the support than the non-tabular silver halide emulsion layer, and the non-tabular silver halide emuslion layer is positioned closer to the support than the surface-protecting layer. The material may include two similar silver halide emulsion layers and a surface-protecting layer on the opposite side of the support. The material provides images with improved sharpness without a decrease in sensitivity while effectively utilizing the amount of silver.

20 Claims, No Drawings

SILVER HALIDE PHOTOGRAPHIC LIGHT-SENSITIVE MATERIAL

This is a continuation of application Ser. No. 447,827 filed 12/8/82 now abandoned.

FIELD OF THE INVENTION

The present invention relates to a silver halide photographic light-sensitive material (hereinafter referred to as "photographic material") and, more particularly, to a photographic material having light-sensitive silver halide emulsion layers containing tubular silver halide grains.

BACKGROUND OF THE INVENTION

In general, photographic materials for use in photographing the inside of a human body using X-rays include X-ray films for indirectly photographing a visible image produced on a fluorescent screen by X-rays utilizing an optical lens system and X-ray films for direct photography which can record an image formed by direct irradiation with X-rays without utilizing lens system (hereinafter referred to as "direct X-ray film").

The present invention is particularly directed to the latter direct X-ray films. Such films usually comprise a transparent support having provided on each side thereof at least one light-sensitive silver halide emulsion layer.

In forming an image on a direct X-ray film by irradiation with X-rays, the film is generally irradiated with X-rays while sandwiched between fluorescent screens, whereby X-ray energy absorbed by the fluorescent screens sandwiching the film is converted to fluorescent light in the blue to green range and the film responds to this fluorescent light to form an image.

Of course, the film responds to the X-ray energy itself to form part of the resulting image, but the proportion of image formed by responding to fluorescent light in the blue to green range overwhelms that formed by responding to X-rays.

As is described above, the combined use of fluorescent screens upon formation of an imag on a direct X-ray film makes it possible to effectively utilize X-ray energy for image formation, and, therefore, provides a great advantage such as reducing the amount of X-ray irradiation upon taking an X-ray photograph of a human body.

However, it is not desirable because sharpness of the image formed is deteriorated.

This defect is based on the following phenomenon. When a direct X-ray film comprising a support having on each side thereof a silver halide emulsion layer is irradiated with X-rays while sandwiched between fluorescent screens, fluorescent light emitted from the fluorescent screen on one side not only forms a latent image (to be developed to a black silver image) in an adjacent silver halide emulsion layer but a considerable portion of the light passes through the support and reaches the silver halide emulsion layer on the opposite side of the support to form another latent image therein, resulting in an indistinct image.

This phenomenon is called "cross-over" in the photographic field.

The degree of this cross-over greatly influences the sharpness of the final image.

An image affected by the cross-over phenomenon appears indistinct seemingly because the fluorescent light diffuses into a silver halide emulsion layer on the opposite side and a support and because diffusion, refraction, and reflection of the light occur around the emulsion layer and the support.

Many studies have been directed to overcome the formation of an indistinct image due to this cross-over phenomenon and to prevent the reduction in sensitivity occurring as a result of reducing the cross-over.

For example, British Pat. No. 1,422,534 discloses a technique of improving sharpness by providing an ultraviolet ray absorbent in a silver halide emulsion layer or between a silver halide emulsion layer and a support to thereby reduce the cross-over.

U.S. Pat. No. 3,989,527 discloses a technique of raising the efficiency of utilizing light and improving sensitivity by incorporating, in an emulsion layer containing spectrally sensitized silver halide grains of $0.9\mu$ or above in particle size, silver halide grains free of spectral sensitization and having a particle size of 0.4 to $0.6\mu$ as a light-scattering substance. British Pat. No. 504,283 discloses a technique of improving sensitivity by incorporating a pigment such as $TiO_2$ or ZnO in a silver halide emulsion layer.

In addition, Japanese Patent Application (OPI) Nos. 31737/79 or 69324/74 (the term "OPI" as used herein refers to a "published unexamined Japanese patent application") discloses a technique of improving sharpness by incorporating a phosphorescent or fluorescent substance such as $CaWO_4$ or $BaSO_4$ in a silver halide emulsion layer or an adjacent layer thereof.

These prior techniques can be roughly classified into the following three types:

(1) reducing cross-over with an ultraviolet ray absorbent, dye, etc.;

(2) effectively utilizing light scattered by a light-scattering substance for raising sensitivity; and (3) incorporating a luminescent substance in an emulsion layer to thereby raise sharpness and eliminate the necessity of screens.

These prior techniques have the following disadvantages.

The technique of reducing cross-over by absorption (type (1) described above) concurrently causes reduction in sensitivity, thus not being practically employable.

Of the techniques falling into type (2), the technique of incorporating silver halide fine grains as light-scattering substance provides only an insufficient effect with report to improving sharpness though it contributes to increased sensitivity and reduces cross-over. In addition, it does not contribute to photographic characteristics due to low sensitivity of fine grains, and is not preferable in view of the present trend toward saving silver. In contrast, when the grain size is made large in order to improve photographic characteristics, a smaller light-scattering effect is obtained with only a small increase in sensitivity.

When using substances other than silver halide as a light-scattering substance, in many cases, they cannot be removed in development processing and, if removed, they themselves are environmentally problematic. In addition, they provide only an insufficient effect with respect to improving sharpness.

The technique of type (3) is also not practical because the luminescent substance seriously exerts a detrimental influence on photographic properties.

Further, it is known that it is possible to improve sensitivity and gradation of not only X-ray films but light-sensitive materials having two or more silver halide emulsions in general by providing a low sensitive silver halide emulsion layer as a lower layer and a high sensitive silver halide emulsion layer as an upper layer.

However, the conventionally known stratum structure has failed to provide sufficient sensitivity and silver-saving effects.

SUMMARY OF THE INVENTION

An object of the present invention is to provide a photographic material which shows improved sharpness without a decrease in sensitivity.

Another object of the present invention is to provide a photographic material which shows good sharpness and efficiently utilizes silver.

A further object of the present invention is to provide a photographic material which has sufficient sensitivity and which effectively utilizes silver.

A still further object of the present invention is to provide a direct X-ray film which shows improved sharpness and which effectively utilizes silver because cross-over with the film can be reduced without a concurrent decrease in sensitivity.

Other objects of the present invention will become more apparent from the following description of the invention and the appended claims.

The above described objects of the present invention are obtained by a silver halide photographic light-sensitive material which is comprised of a transparent support having provided on one side of least two silver halide emulsion layers and a surface-protecting layer, wherein one of the two silver halide emulsion layers contains tabular silver halide grains having a diameter at least 5 times the thickness of the grains (hereinafter referred to as "tabular silver halide emulsion layer"), and the other of the two silver halide emulsion layers contains non-tabular silver halide grains (hereinafter referred to as "non-tabular silver halide emulsion layer"), and wherein the tabular silver halide emulsion layer is positioned closer to the support than the non-tabular silver halide emulsion layer and the non-tabular silver halide emulsion layer is positioned closer to the support than the surface-protecting layer (top layer). The material may include a plurality of additional layers on the same side of the support or on the opposite side of the support.

DETAILED DESCRIPTION OF THE INVENTION

A characteristic aspect of the present invention resides in that the photographic material has a tabular silver halide emulsion layer containing tabular silver halide grains and, outside this layer (on the surface side), at least one non-tabular silver halide emulsion layer. In a preferable embodiment, the above described combination of silver halide emulsion layers are provided on each side of a support.

In view points for increasing sensitivity (speed) and effectively utilizing silver, it is sufficient that at least one combination of the tabular silver halide emulsion layer and the non-tabular silver halide emulsion layer of the present invention is present only one side of the support. Further, in view point for preventing reduction in sharpness of the final image due to cross-over phenomenon in addition to the above view points for increasing sensitivity and effectively utilizing silver, at least one combination of the tabular silver halide emulsion layer and the non-tabular silver halide emulsion layer of the present invention is present on each side of the support.

A photographic material having a tabular silver halide emulsion layer containing tabular silver halide grains and outside the tabular silver halide emulsion layer, a non-tabular silver halide emulsion layer on one side of a support and only a non-tabular silver halide emulsion layer on the other side of the support is improved with respect to the cross-over phenomenon as compared to conventional photographic materials. However, a photographic material having such a combination of silver halide emulsion layers on each side is more preferable.

The photographic material of the present invention may have a variety of different structures. The invention is characterized by the use of a transparent support which has provided on one side at least two silver halide emulsion layers and a surface-protecting layer. One of the two silver halide emulsion layers is a tabular silver halide emulsion layer containing tabular silver halide grains having a diameter at least 5 times the thickness of the grains. The other of the two silver halide emulsion layers is a non-tabular silver halide emulsion layer containing non-tabular silver halide grains. The tabular silver halide emulsion layer is positioned closer to the support than the non-tabular silver halide emulsion layer. The non-tabular silver halide emulsion layer is positioned closer to the support than the surface-protecting layer which generally serves as the top layer of the material.

The following seven embodiments are examples of different structures which the present invention may have. However, it should be noted that the present invention is not limited to these structures and that all or any of the structures may include additional layers.

Embodiment (1)

In accordance with embodiment (1) a transparent support base is porvided and has positioned thereon two silver halide emulsion layers and a surface-protecting layer on one side of the support wherein one of the two silver halide emulsion layers which is positioned closer to the support base is comprised of tabular silver halide grains and the other of the two silver halide emulsion layers which is closer to the support than the surface-protecting layer is comprised of a high speed silver halide grains. The surface-protecting layer such as a gelatin layer serves as the top surface layer of the photographic material. The tabular silver halide grains have a diameter/thickness ratio of 5/1 or more. The high speed non-tabular silver halide emulsion layer contains high speed spherical or polyhedral silver halide grains having a comparatively large particle size (0.5 to 3.0$\mu$). The diameter/thickness ratio of the high speed grains is less than 5/1. The high speed non-tabular silver halide emulsion layer is preferably positioned directly on the tabular silver halide emulsion layer. More preferably, the tabular silver halide emulsion layer is positioned directly on the support, the high speed non-tabular silver halide emulsion layer is positioned directly on the tabular silver halide emulsion layer and the surface-protecting layer is provided directly on the high speed non-tabular silver halide emulsion layer.

Embodiment (2)

In accordance with embodiment (2) a transparent support base is provided and a tabular silver halide emulsion layer is provided on one side of the support along with a plurality of non-tabular silver halide emulsion layers and a surface-protecting gelatin layer. The tabular silver halide emulsion layer is positioned closer to the support than the plurality of non-tabular silver halide emulsion layers which are in turn positioned closer to the support than the surface-protecting gelatin layer. Preferably, the plurality of non-tabular silver halide emulsion layers are directly provided on the tabular silver halide emulsion layer. More preferably, the tabular silver halide emulsion layer is directly provided on the support and the plurality of non-tabular silver halide emulsion layers are directly provided thereon and the surface protecting gelatin layer is directly provided thereon.

Embodiment (3)

In accordance with embodiment (3) a transparent support base is provided and has provided thereon a non-tabular silver halide emulsion layer, a tabular silver halide emulsion layer, a high speed non-tabular silver halide emulsion layer and a surface-protecting gelatin layer on one side of the support. The non-tabular silver halide emulsion layer is positioned closer to the support than the tabular silver halide emulsion layer. The tabular silver halide emulsion layer is positioned closer to the support than the high speed non-tabular silver halide emulsion layer. The high speed non-tabular silver halide emulsion layer is positioned closer to the support than the surface-protecting gelatin layer. The layers are preferably positioned in contact with each other. However, all or any of them may be separated by additional layers.

Embodiment (4)

In accordance with embodiment (4) an ultraviolet absorbent- or dye-containing layer, a tabular silver halide emulsion layer, a non-tabular silver halide emulsion layer and a surface-protecting layer are provided on one side of a support. The ultraviolet absorbent- or dye-containing layer is positioned closer to the support than the tabular silver halide emulsion layer. The tabular silver halide emulsion layer is positioned closer to the support than the non-tabular silver halide emulsion layer, and the non-tabular silver halide emulsion layer is positioned closer to the support than the surface-protecting gelatin layer. The layers are preferably positioned in contact with each other. However, all or any of the layers may be separated by additional layers.

Embodiment (5)

In accordance with embodiment (5) a transparent support base is provided and has provided on one side thereof a tabular silver halide emulsion layer which contains tabular silver halide grains and an ultraviolet ray absorbent or a dye, a non-tabular silver halide emulsion layer and a surface-protecting gelatin layer. The tabular silver halide emulsion layer is positioned closer to the support than the non-tabular silver halide emulsion layer which is in turn positioned closer to the support than the surface-protecting layer. The layers are preferably positioned in contact with each other but may be separated from each other by additional layers.

Embodiment (6)

In accordance with embodiment (6) there is provided a tabular silver halide emulsion layer, a high speed non-tabular silver halide emulsion layer (as described above) and a surface-protecting layer provided on both sides of a support. The tabular silver halide emulsion layer is positioned closer to the support than the high speed non-tabular silver halide emulsion layer which is in turn positioned closer to the support than the surface-protecting layer. The high speed non-tabular silver halide emulsion layer is preferably directly provided on the tabular silver halide emulsion layer. More preferably the tabular silver halide emulsion layer is provided directly on each side of the support, the high speed non-tabular silver halide emulsion layer is directly provided on each of the tabular silver halide emulsion layers on each side of the support, and each of the high speed non-tabular silver halide emulsion layers is then coated with a surface-protecting layer. Therefore, in accordance with this most preferred embodiment the support is provided and is coated with three layers on each side which are in direct contact with each other. That is, two tabular silver halide emulsion layers directly contact the support and are directly coated with high speed non-tabular silver halide emulsion layers which are in turn each coated with a surface-protecting layer.

Embodiment (7)

In accordance with embodiment (7) a structure as described above in embodiment (2) is used and, furthermore, the same silver halide layers and surface-protecting layers are provided on the opposite side of the support. In accordance with the particularly preferred structure of the embodiment (7) a tabular silver halide emulsion layer is provided on each side of a support and is directly coated with a plurality of non-tabular silver halide emulsion layers which are in turn coated with a surface-protecting layer. However, additional layers may be present which separate all or any of the layers.

With respect to the embodiments (1) to (7) described above, the inventors have found that the order of preference is as follows: (6), (1), (7), (2), (3), (4) and (5). Wherein the embodiments (6) is the most preferred of the disclosed embodiments.

The tabular silver halide grains to be used in the present invention are described below.

The tabular silver halide grains of the present invention have a diameter/thickness ratio of 5/1 or more, preferably 5/1 to 100/1, particularly preferably 5/1 to 50/1, most preferably 7/1 to 20/1.

The term "diameter of silver halide grain" means the diameter of a circle having an equal area to the projected area of a grain. In the present invention, the diameters of the tabular silver halide grains range from 0.5 to 10$\mu$, preferably from 0.5 to 5.0$\mu$, particularly preferably from 1.0 to 4.0$\mu$.

In general, tabular silver halide grains are in a tabular form having two parallel planes. Therefore, the "thickness" of the grain is presented, in the present invention, as a distance between the two parallel planes constituting the tabular silver halide grain.

As to the halide composition of the tabular silver halide grains, silver bromide and silver bromoiodide are preferable, with silver bromoiodide containing 0 to 10 mol% silver iodide being particularly preferable.

Processes for preparing the tabular silver halide grains are described below.

The tabular silver halide grains can be prepared by properly combining processes known to those skilled in the art. That is, the tabular silver halide grains having a diameter/thickness ratio of 5/1 or more used in the present invention are not particularly described but can be prepared in the manner similar to the processes as described, for example, in U.S. Pat. Nos. 4,067,739, 4,063,951, 4,184,877 and 4,184,878, *Photographic Journal,* Vol. 79, page 330 (1939), *Photographic Science & Engineering,* Vol. 15, No. 3, page 189 (1971) and *Photographic Science & Engineering,* Vol. 14, No. 4, pages 248 to 257 (1970).

For example, the tabular silver halide grains can be obtained by forming seed crystals containing 40 wt% or more tabular grains in an environment of a comparatively high pAg value of, for example, not more than 1.3 in pBr, and simultaneously adding thereto a silver salt solution and a halide solution while maintaining the pBr value at about the same level to thereby allow the seed crystals to grow.

In the step of the crystal growth, addition of the silver salt solution and the halide solution are desirably conducted so that new crystal nuclei are not generated.

The size of tabular silver halide grain can be properly adjusted by adjusting temperature, selecting kind and amount of a solvent, and controlling the speed of adding silver salt and halide upon crystal growth.

Particle size, form of particles (diameter/thickness ratio, etc.), particle size distribution, and particle-growing rate can be controlled by using, if desired, a silver halide solvent upon production of tabular silver halide grains of the present invention. Such solvent is used in an amount of $10^{-3}$ to 1.0 wt%, preferably $10^{-2}$ to $10^{-1}$ wt%, of a reaction solution.

For example, the particle size distribution can be made monodispersed and particle-growing rate can be accelerated by increasing the amount of the solvent. On the other hand, the use of an increased amount of the solvent tends to increase the thickness of resulting grains.

Silver halide solvents often used include ammonia, thioethers, thioureas, etc. As to thioethers, reference can be made to U.S. Pat. Nos. 3,271,157, 3,790,387, 3,574,628, etc.

Upon production of the tabular silver halide grains of the present invention, the silver salt solution (for example, an $AgNO_3$ aqueous solution) and the halide solution (for example, a KBr aqueous solution) are added in such manner that the adding rate, added amounts and added concentrations are increased in order to accelerate the grain growth. Such process is described in British Pat. No. 1,335,925, U.S. Pat. Nos. 3,672,900, 3,650,757, 4,242,445, Japanese Patent Application (OPI) Nos. 142329/80, 158124/80, etc.

The tabular silver halide grains of the present invention can be chemically sensitized as the occasion demands.

Useful chemically sensitizing methods include gold sensitization using a so-called gold compound (e.g., U.S. Pat. Nos. 2,448,060, 3,320,069, etc.), metal sensitization using iridium, platinum, rhodium, palladium, etc. (e.g., U.S. Pat. Nos. 2,448,060, 2,566,245, 2,566,263, etc.), sulfur sensitization using a sulfur-containing compound (e.g., U.S. Pat. No. 2,222,264, etc.), and reduction sensitization using a tin salt or a polyamine (e.g., U.S. Pat. Nos. 2,487,850, 2,518,698, 2,521,925, etc.). These methods can be employed alone or in combination of two or more of them.

From the point of saving silver, the tabular silver halide grains of the present invention are preferably subjected to gold sensitization, sulfur sensitization, or a combination thereof.

The tabular silver halide emulsion layer containing the tabular silver halide grains of the present invention may contain silver halide grains other than the tabular silver halide grains of the present invention. However, the tabular silver halide emulsion layer of the present invention preferably contains 40% by weight or more, particularly preferably 60% by weight or more, of the tabular silver halide grains of the present invention based on all the silver halide grains present in the tabular silver halide emulsion layer.

The tabular silver halide emulsion layer containing the tabular silver halide grains preferably has a thickness of 0.5 to 5.0μ, particularly preferably 1.0 to 3.0μ.

The tabular silver halide grains are preferably coated in an amount of 0.25 to 3 g/m$^2$, particularly preferably 0.5 to 2 g/m$^2$ per one tabular silver halide emulsion layer.

Other constituents of the layer containing the tabular silver halide grains of the present invention, such as a binder, a hardener, an antifogging agent, a silver halide stabilizing agent, a surfactant, an optically sensitizing dye, a dye, an ultraviolet ray absorbent, a chemically sensitizing agent, a color coupler, etc., are not particularly limited. The constituents are described in publications such as Research Disclosure, Vol. 176, pages 22 to 28 (December 1978).

For example, as the antifogging agent, various compounds such as azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.); mercaptopyrimidines; mecaptotriazines; thioketo compounds such as oxazolinethione; azaindenes (e.g., triazaindenes, tetraazaindenes (particular 4-hydroxy-substituted(1,3,3a,7-)tetraazaindenes), pentaazaindenes, etc.); benzenethiosulfonic acid, benzenesulfinic acid, benzenesulfonic acid amide, etc., known as antifogging agents or stabilizers can be added. For example, those described in U.S. Pat. Nos. 3,954,474, 3,982,947, and Japanese Patent Publication No. 28660/77 can be used.

Useful surfactants include nonionic surfactants such as saponin (steroid type), alkylene oxide derivatives (e.g., polyethylene glycol, polyethylene glycol/polypropylene glycol condensate, polyethylene glycol alkyl ether, polyethylene glycol alkylaryl ether, polyethylene glycol ester, polyethylene glycol sorbitan ester, polyalkylene glycol alkylamine or amide, polyethylene oxide adduct of silicone, etc.), glycidol derivatives (e.g., alkenylsuccinic acid polyglyceride, alkylphenol polyglyceride, etc.), fatty acid esters of polyhydric alcohols, and sugar alkyl esters; anionic surfactants having acidic groups such as carboxy group, sulfo group, phospho group, sulfuric acid ester group or phosphoric acid ester group, such as alkylcarboxylic acid salts, alkylsulfonic acid salts, alkylbenzenesulfonic acid salts, alkylnaphthalenesulfonic acid salts, alkylsulfuric esters, alkylphosphoric esters, N-acyl-N-alkyl-taurines, sulfosuccinic esters, sulfoalkylpolyoxyethylene alkylphenyl ethers, polyoxyethylene alkylphosphoric esters, etc.; amphoteric surfactants such as amino acids, aminoalkylsulfonic acids, aminoalkylsulfuric acid esters, aminoalkylphosphoric acid esters, alkylbetaines, amine oxides, etc.; and cationic surfactants such as alkylamine salts, aliphatic or aromatic quaternary ammonium salts, heterocyclic quaternary ammonium salts (e.g., pyridinium or imidazolium), aliphatic or hetero ring-containing phosphonium or sulfonium salts.

The structure of a non-tabular silver halide emulsion layer will now be described.

The non-tabular silver halide grains used in the non-tabular silver halide emulsion layer are preferably in a spherical form, a polyhedral form, or in a mixed form thereof. The non-tabular silver halide grains have a diameter/thickness ratio of less than 5/1.

The non-tabular silver halide grains preferably have a mean particle size of 0.5 to 3μ, and can be allowed to grow, if desired, by using a solvent such as ammonia, thioether, thiourea, or the like.

The other constituents of the non-tabular silver halide emulsion layer are not particularly restructed, as is the case with the layer containing tabular silver halide grains. Reference can be made to the foregoing Research Disclosure, Vol. 176 with respect to such constituents.

The non-tabular silver halide emulsion layer containing the non-tabular silver halide grains may contain silver halide grains other than the non-tabular silver halide grains. However, the non-tabular silver halide emulsion layer preferably contains 60% by weight or more of the non-tabular silver halide grains (having a diameter/thickness ratio of less than 5/1) based on all the silver halide grains present in the non-tabular silver halide emulsion layer.

Of the above non-tabular silver halide emulsion layer, the structure of a non-tabular silver halide emulsion layer to be provided on the outer (or surface) side of the tabular silver halide emulsion layer containing tabular silver halide grains of the present invention (hereinafter referred to as "upper emulsion layer") will now be described.

Silver halide grains which are preferably used in the upper emulsion layer include high speed silver halide grains used for ordinary direct X-ray films.

The silver halide grains in the upper emulsion layer are preferably made highly sensitive by sensitization with gold or other metals, reduction sensitization, sulfur sensitization, or a combination of two or more of them.

The ratio of the silver amount of the upper emulsion layer to that of the tabular silver halide emulsion layer containing tabular silver halide grains is preferably 0.1 to 10, particularly preferably 0.2 to 4.0. As to sensitivity difference therebetween, the upper emulsion layer is desirably more sensitive by −0.3 to 0.6, more preferably 0 to 0.6, particularly preferably 0.2 to 0.4 in terms of Δ log E.

The photographic material of the present invention has a surface-protecting layer containing as a major component a natural or synthetic high polymer such as gelatin, a water-soluble polyvinyl compound or acrylamide polymer (e.g., U.S. Pat. Nos. 3,142,568, 3,193,386, 3,062,674, etc.).

In addition to gelatin or other high molecular substances, the surface-protecting layer can contain a surfactant, an antistatic agent, a matting agent, a lubricant, a hardening agent, a thickening agent, etc.

Useful supports of the photographic material of the present invention include cellulose ester films such as cellulose triacetate film, polyester films such as polyethylene terephthalate film, etc., and polycarbonate film. The thickness of the support is 100 to 300μ, preferably 150 to 220μ. The support used in the present invention is, of course, coated with a subbing layer.

The support to be used in the present invention must be transparent, but it may be dyed with a dye.

In the present invention, methods for coating photographic layers such as a layer containing tabular grains, an upper emulsion layer, and a surface-protecting layer on a support are not particularly limited, and methods for coating two or more layers at the same time described in, for example, U.S. Pat. Nos. 2,761,418, 3,508,947, 2,761,791, etc., are preferably employed.

Silver halide grains having a large diameter/thickness ratio are not generally preferable for direct X-ray films because they provide iamges of mild tone by development due to their special reflection properties. In the present invention, however, this undesirable mild tone is greatly depressed by providing an additional silver halide grain-containing layer on the layer containing tabular silver halide grains.

In addition, silver halide grains of, particularly, a comparatively large particle size generally tend to be susceptible to mechanical stress and desensitized, but the constitution of the photographic light-sensitive material of the present invention serves to apparently depress such desensitization.

The present invention will now be described in more detail by the following non-limiting examples of preferred embodiments of the present invention.

EXAMPLE 1

(1) Preparation of a silver halide emulsion for an upper emulsion layer

Spherical grains (mean particle size: 1.35μ) of silver bromoiodide (silver iodide: 1.5 mol%) were formed by a double jet technique in the presence of ammonia, and chemically sensitized with a chloroaurate and sodium thiosulfate. After completion of the chemical sensitization, an antifogging agent and a coating aid were added thereto to prepare a coating solution for forming an upper emulsion layer. This coating solution had a specific gravity of 1.175 and a silver-to-gelatin weight ratio of 1.55/1.

(2) Preparation of an emulsion containing tabular silver halide grains 30 g of gelatin, 10.3 g of potassium bromide, and 10 cc of a 0.5% thioether [$HO(CH_2)_2S(CH_2)_2S(CH_2)_2OH$] aqueous solution were added to 1 liter of water and kept at 70° C. (pAg: 9.1; pH: 6.5) in a vessel. The following solutions I and II were simultaneously added thereto in 15 seconds, then solutions III and IV were simultaneously added thereto over 65 minutes according to double jet technique.

| | Solution I | Solution II | Solution III | Solution IV |
|---|---|---|---|---|
| $AgNO_3$ (g) | 4.5 | — | 95.5 | — |
| $H_2O$ (cc) | 17 | 16.7 | 561 | 542 |
| KBr (g) | — | 3.15 | — | 69.6 |
| 5 wt % aq. soln. of $HO(CH_2)_2S(CH_2)_2S(CH_2)_2OH$ (cc) | — | 0.45 | — | 9.6 |

The thus obtained tabular silver halide grains had a mean diameter of 0.83μ and a mean diameter/thickness ratio of 10.5/1.

A coating aid and an antifogging agent were added to the resulting emulsion to prepare a coating solution for forming a layer containing tabular silver halide grains.

This coating solution had a specific viscosity of 1.08 and a silver-to-gelatin weight ratio of 1.50/1.

(3) Preparation of a comparative silver halide emulsion 15 g of gelatin was added to 1 liter of water, 3.0 cc of a 25% ammonia aqueous solution was added thereto, and the resulting mixture was kept at 50° C. in a vessel. An $AgNO_3$ aqueous solution and a KBr aqueous solution were added thereto at the same time while maintaining the pAg at 8.28.

The thus obtained silver halide grains were regular hexahedral grains having a mean particle size of 0.40μ.

(4) Preparation of a coating solution for forming a surface-protecting layer

A 10% gelatin aqueous solution containing gelatin, sodium polystyrenesulfonate, polymethyl methacrylate fine particles (mean particle size: 3.0μ), saponin, and 2,4-dichloro-6-hydroxy-s-triazine was prepared as a coating solution for forming a surface-protecting layer.

(5) Preparation of a photographic material

On a 180μ thick undercoated polyethylene terephthalate film were coated an emulsion layer containing tabular silver halide grains or a comparative emulsion layer, an upper emulsion layer, and a surface-protecting layer in this order as shown in Table 1 according to a simultaneous extrusion-coating method, then dried.

The three layers were likewise coated, in the same order as described above, on the other side of the support to prepare photographic material samples (1) to (5).

The silver amounts coated on one side were as tabulated in Table 1. The coated gelatin amount in the surface-protecting layer was 1.1 g/m².

(6) Measurement of degree of corss-over and sensitivity

The degree of corss-over was determined as a difference in sensitivity (Δ log E) between an emulsion layer on an exposure side and an emulsion layer on the opposite side measured by exposing the light-sensitive material only from one side.

Exposure was conducted by using a Hi Standard screen using calcium tungstate (made by Fuji Photo Film Co., Ltd.), and development was conducted at 20° C. for 4 minutes using Hi Rendol made by Fuji Photo Film Co., Ltd.

The sensitivity on each surface was compared in terms of a logarithm of a reciprocal of an exposure amount required for attaining an effective density of 0.3 excluding fog, and presented as a difference from the sensitivity of photographic material (1).

TABLE 1

| Sample No. | Coated Ag Amount of Upper Emulsion Layer (per one side) (g/m²) | Lower Emulsion Layer: Kind of Emulsion | Lower Emulsion Layer: Amount of Coated Ag (per one side) (g/m²) | Cross-Over (Δlog E) | Sensitivity on Each Side |
|---|---|---|---|---|---|
| (1) | 3.9 | — | — | 0.31 | 0 |
| (2) (Present Invention) | 3.9 | Tabular grains | 0.25 | 0.35 | +0.01 |
| (3) (Present Invention) | 3.9 | Tabular grains | 0.90 | 0.48 | +0.02 |
| (4) (Comparison) | 3.9 | Regular hexahedral grains | 0.50 | 0.38 | −0.02 |
| (5) (Comparison) | 3.9 | Regular hexahedral grains | 0.70 | 0.48 | −0.03 |

As is clear from Table 1, it is seen that samples (2) and (3) in accordance with the present invention can reduce cross-over while increasing sensitivity.

On the other hand, though comparative samples (3) and (4) using an emulsion containing regular hexahedral fine grains can reduce cross-over, they undergo corresponding desensitization.

(7) Comparison of sharpness

Influence of reducing cross-over on sharpness was examined with samples (1), (2), (3) and (5).

The sharpness was presented as CTF (Contrast Transfer Function).

The results thus obtained are shown in Table 2. In Table 2, the nearer the CTF (%) value to 100, the better the sharpness.

TABLE 2

| Space Frequency (line/mm) | CTF (%) Sample (1) | Sample (2) | Sample (3) | Sample (5) |
|---|---|---|---|---|
| 0.5 | 94.5 | 97.0 | 99.0 | 90.0 |
| 1.0 | 80.0 | 82.5 | 85.5 | 81.0 |
| 1.5 | 65.5 | 69.0 | 72.5 | 68.0 |
| 2.0 | 53.5 | 57.0 | 62.0 | 61.5 |
| 2.5 | 45.0 | 48.5 | 52.5 | 49.0 |
| 3.0 | 37.0 | 39.5 | 43.0 | 38.5 |
| 4.0 | 23.0 | 29.0 | 32.0 | 26.0 |

As is clear from Table 2, samples (2) and (3) in accordance with the present invention showed improved sharpness (CTF) due to the existence of tabular grains, whereas sample (5) using 0.4μ hexahedral grains showed less sharpness-improving effect.

EXAMPLE 2

(1) Preparation of an emulsion containing tabular silver halide grains

About the same procedures as in Example 1 were conducted except for adding 2 g of KI to solution IV.

The thus obtained tabular silver halide grains had a mean diameter of 2.80μ and a mean diameter/thickness ratio of 11.0/1.

The silver halide grains were chemically sensitized with a chloroaurate and sodium thiosulfate to such a degree that they were less sensitive than the upper emulsion layer by 0.25 in Δ log E, then a coating aid and an antifogging agent were added thereto.

(2) Preparation of a comparative emulsion containing spherical grains

In the same manner as with the emulsion for upper layer described in Example 1, there was prepared an emulsion containing spherical silver bromoiodide emulsion having a mean particle size of 0.90μ and an iodide content of 2.0 mol%. The silver-to-gelatin ratio was 1.5/1.

(3) Preparation of photographic materials

The same upper emulsion layer and surface-protecting layer as described in Example 1 and the same lower emulsion layer of silver halide emulsion as prepared in foregoing (1) or (2) were provided on each side of a polyethylene terephthalate film in a manner shown in Table 3.

(4) Measurement of cross-over, $\overline{G}$, and Dmax

Sensitivity of the whole silver halide emulsion layers on both sides of the support, $\overline{G}$, and maximum density (Dmax) of the thus obtained photographic material samples (6) to (10) were measured in the same manner as in Example 1 to obtain results shown in Table 3.

$\overline{G}$ means a gradient of a straight line drawn between a point on a characteristic curve at which density is 0.25 excluding fog and a point at which density is 2.0 excluding fog.

TABLE 3

| Sample No. | Coated Ag Amount of Upper Emulsion Layer (per one side) (g/m²) | Lower Emulsion Layer: Grain Form | Lower Emulsion Layer: Coated Ag Amount (per one side) (g/m²) | Sensitivity | $\overline{G}$ | Dmax |
|---|---|---|---|---|---|---|
| (6) | 3.4 | — | — | 0 | 2.70 | 2.9 |
| (7) (Present Invention) | 2.9 | Tabular | 0.5 | +0.03 | 2.70 | 3.4 |
| (8) (Present Invention) | 2.4 | " | 1.0 | +0.03 | 2.70 | 4.5 |
| (9) (Present Invention) | 1.9 | " | 1.5 | +0.03 | 2.65 | 5.3 |
| (10) (Comparison) | 2.4 | Spherical | 1.0 | −0.05 | 2.50 | 3.2 |

As is clear from Table 3, samples (7), (8) and (9) in accordance with the present invention showed increased sensitivity and Dmax, though the amount of coated silver was definite (6.8 g/m² as a sum of silver coated on both sides). On the other hand, comparative sample (10) using spherical particles showed decreased sensitivity and Dmax.

(5) Measurement of sharpness

Sharpness was measured in the same manner as in Example 1 to obtain the results given in Table 4.

TABLE 4

| Space Frequency (line/mm) | CTF (%): Sample (6) | Sample (7) (Present Invention) | Sample (8) (Present Invention) | Sample (9) (Present Invention) | Sample (10) (Comparison) |
|---|---|---|---|---|---|
| 0.5 | 91 | 95 | 97.5 | 99.5 | 90 |
| 1 | 78 | 81 | 82.5 | 83 | 78.5 |
| 1.5 | 62.5 | 67.5 | 68.5 | 70.5 | 65 |
| 2 | 50.5 | 53 | 55 | 57.5 | 52.5 |
| 2.5 | 39.5 | 45 | 46.5 | 49.5 | 43 |
| 3 | 32 | 35 | 36 | 37.5 | 34 |
| 4 | 22 | 25 | 26.5 | 28.5 | 24 |

As is clear from Table 4, samples (7), (8), and (9) in accordance with the present invention showed remarkably improved sharpness, whereas comparative sample (10) using spherical grains showed extremely low sharpness-improving effect.

In order to attain about the same $\overline{G}$ and sharpness as that of the photographic materials of the present invention by providing only an upper emulsion layer, 9.0 g/m² of silver was necessary as a sum amount of silver coated on both sides.

In addition, 12.4 g/m² of silver was necessary for attaining about the same Dmax.

These facts also show the great advantage of the present invention in view of saving silver.

EXAMPLE 3

(1) Preparation of a silver halide emulsion for upper emulsion layer

This emulsion was prepared in the same manner as with the silver halide emulsion for upper emulsion layer used in Example 1.

(2) Preparation of a silver halide emulsion for lower emulsion layer (2-1) Preparation of a tabular silver halide emulsion This emulsion was prepared in the same manner as with the tabular silver halide emulsion used in Example 2. The silver halide grains had a mean diameter of 3.50μ and a mean diameter/thickness ratio of 12.0/1.

(2-2) Preparation of a spherical silver halide emulsion for comparison

This emulsion was prepared in the same manner as with the comparative spherical grains in Example 2. The grains had a mean particle size of 1.3μ.

(3) Preparation of photographic materials

On one side of an undercoated cellulose triacetate film support were simultaneously coated a lower emulsion layer, an upper emulsion layer, and a surface-protecting layer as shown in Table 5 to prepare photographic material samples (11) to (15).

The surface-protecting layer had absolutely the same formulation as that used in Example 1.

(4) Measurement of sensitivity

Each of the thus obtained samples (11) to (14) was exposed using a tungsten light source, and developed in a D-76 developer (formulation being opened by Eastman Kodak Company) at 20° C. for 8 minutes.

The sensitivity was determined as a logarithm of a reciprocal of an exposure amount required for attaining an effective density of 0.1 excluding fog, and presented as a difference from that of photographic sample (11) which was taken as a standard.

The results thus obtained are tabulated in Table 5.

As is clear from Table 5, it is seen that samples (12) and (13) in accordance with the present invention had higher sensitivity than that of the comparative samples.

TABLE 5

| Sample No. | Amount of Coated Ag in Upper Emulsion Layer ($g/m^2$) | Lower Emulsion Layer | | |
|---|---|---|---|---|
| | | Grain Form | Amount of Coated Ag ($g/m^2$) | Sensitivity |
| (11) (Control) | 2.5 | — | — | 0 |
| (12) (Present Invention) | " | Tabular | 1.0 | +0.06 |
| (13) (Present Invention) | " | Tabular | 2.0 | +0.08 |
| (14) (Comparison) | " | Spherical | 1.0 | +0.01 |
| (15) (Comparison) | " | Spherical | 2.0 | +0.01 |

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material, comprising:

a transparent support having provided on one side thereof;

at least two silver halide emulsion layers; and a surface-protecting layer, wherein one of the two silver halide emulsion layers is a tabular silver halide emulsion layer containing tabular silver halide grains having a diameter at least 5 times the thickness of the grain, the other of the two silver halide emulsion layers is a non-tabular silver halide emulsion layer containing non-tabular silver halide grains, the tabular silver halide emulsion layer being positioned closer to the support than the non-tabular silver halide emulsion layer, and the non-tabular silver halide emulsion layer being positioned closer to the support than the surface-protecting layer;

an additional tabular silver halide emulsion layer;

an additional non-tabular silver halide emulsion layer; and an additional surface-protecting layer, wherein the additional tabular silver halide emulsion layer, the additional non-tabular silver halide emulsion layer and the additional surface-protecting layer are provided on the opposite side of the support from the tabular silver halide emulsion layer, non-tabular silver halide emulsion layer and surface-protecting layer, the additional tabular silver halide emulsion layer being positioned closer to the support than the additional non-tabular silver halide emulsion layer, and the additional non-tabular silver halide emulsion layer being positioned closer to the support than the additional surface-protecting layer, wherein both upper non-tabular silver halide emulsion layers are more sensitive by 0 to 0.6 in terms of $\Delta$ log E then the sensitivity of the tabular silver halide emulsion layers.

2. A silver halide photographic light-sensitive material as claimed in claim 1, wherein the non-tabular silver halide emulsion layer is positioned directly on the tabular silver halide emulsion layer and the additional non-tabular silver halide emulsion layer is positioned directly on the additional tabular silver halide emulsion layer.

3. A silver halide photographic light-sensitive material as claimed in claim 1, wherein the tabular silver halide grains have a diameter/thickness ratio within the range of 5/1 to 100/1.

4. A silver halide photographic light-sensitive material as claimed in claim 3, wherein the diameter/thickness ratio is within the range of 5/1 to 50/1.

5. A silver halide photographic light-sensitive material as claimed in claim 4, wherein the diamether/thickness ratio is within the range of 7/1 to 20/1.

6. A silver halide photographic light-sensitive material as claimed in claim 1, wherein the tabular silver halide grains have a diameter within the range of from 0.5 to 10$\mu$.

7. A silver halide photographic light-sensitive material as claimed in claim 6, wherein the tabular silver halide grains have a diameter within the range of from 0.5 to 5.0$\mu$.

8. A silver halide photographic light-sensitive material as claimed in claim 7, wherein the tabular silver halide grains have a diameter within the range of 1.0 to 4.0$\mu$.

9. A silver halide photographic light-sensitive material as claimed in claim 1, wherein the tabular silver halide emulsion layer has a thickness within the range of 0.5 to 5.0$\mu$.

10. A silver halide photographic light-sensitive material as claimed in claim 9, wherein the thickness of the tabular silver halide emulsion layer is within the range of 1.0 to 3.0$\mu$.

11. A silver halide photographic light-sensitive material as claimed in claim 1, wherein the tabular silver halide grains are present on the support in an amount of 0.25 to 3 $g/m^2$ per one tabular silver halide emulsion layer.

12. A silver halide photographic light-sensitive material as claimed in claim 11, wherein the tabular silver halide grains are present on the support in an amount of 0.5 to 2 $g/m^2$ per one tabular silver halide emulsion layer.

13. A silver halide photographic light-sensitive material as claimed in claim 1, wherein the non-tabular silver halide emulsion layer contains non-tabular silver grains having a mean particle size of 0.5 to 3$\mu$.

14. A silver halide photographic light-sensitive material as claimed in claim 1, wherein the ratio of the silver in the upper non-tabular silver halide emulsion layer to the silver in the tabular silver halide emulsion layer is 0.1 to 10.

15. A silver halide photographic light-sensitive material as claimed in claim 14, wherein the ratio of the amount of silver in the upper non-tabular silver halide emulsion layer to the silver in the tabular silver halide emulsion layer is 0.2 to 4.0.

16. A silver hlaide photographic light-sensitive material as claimed in claim 1, wherein the sensitivity of the upper non-tabular silver halide emulsion layer is more sensitive by 0.2 to 0.4 in terms of Δ log E than the sensitivity of the tabular silver halide emulsion layer.

17. A silver halide photographic light-sensitive material as claimed in claim 1, wherein the transparent support has a thickness within the range of 100 to 300μ.

18. A silver halide photographic light-sensitive material as claimed in claim 17, wherein the support has a thickness within the range of 150 to 220μ.

19. A silver halide photographic light-sensitive material as claimed in claim 1, wherein the tabular silver halide grains have a diameter/thickness ratio within the range of 5/1 to 100/1, the tabular silver halide grains have a diameter within the range of from 0.5 to 10μ, the tabular silver halide emulsion layer has a thickness within the range of 0.5 to 5.0μ, the tabular silver halide grains are present on the support in an amount of 0.25 to 3 g/m$^2$ per one tabular silver halide emulsion layer, the non-tabular silver halide emulsion layer contains non-tabular silver grains having a means particle size of 0.5 to 3μ, the ratio of the silver in the upper non-tabular silver halide emulsion layer to the silver in the tabular silver halide emulsion layer is 0.1 to 10 and wherein the sensitivity of the upper non-tabular silver halide emulsion layer is more sensitive by −0.3 to 0.6 in terms of Δ log E than the sensitivity of the tabular silver halide emulsion.

20. A silver halide photographic light-sensitive material as claimed in claim 1, wherein the diameter/thickness ratio is within the range of 5/1 to 50/1, the tabular silver halide grains have a diameter within the range of from 0.5 to 5μ, the thickness of the tabular silver halide emulsion layer is within the range of 1.0 to 3.0μ, the tabular silver halide grains are present on the support in an amount of 0.5 to 2 g/m$^2$ per one tabular silver halide emulsion layer, the non-tabular silver halide emulsion layer contains non-tabular silver halide grains having a mean particle size of 0.5 to 3μ, the ratio of the amount of silver in the upper non-tabular silver halide emulsion to the silver in the tabular silver halide emulsion layer is 0.2 to 4.0 and wherein the sensitivity of the upper non-tabular silver halide emulsion layer is more sensitive by 0 to 0.6 in terms of Δ log E than the sensitivity of the tabular silver halide emulsion layer.

* * * * *